US007101056B2

(12) United States Patent
Pare

(10) Patent No.: US 7,101,056 B2
(45) Date of Patent: Sep. 5, 2006

(54) ILLUMINATED LED STREET SIGN

(75) Inventor: Jean Pare, Lacline (CA)

(73) Assignee: GELcore LLC, Valley View, OH (US)

( * ) Notice: Subject to any disclaimer, the term of this patent is extended or adjusted under 35 U.S.C. 154(b) by 43 days.

(21) Appl. No.: 10/644,412

(22) Filed: Aug. 20, 2003

(65) Prior Publication Data

US 2004/0109330 A1 Jun. 10, 2004

Related U.S. Application Data

(63) Continuation-in-part of application No. 10/394,956, filed on Mar. 21, 2003.

(60) Provisional application No. 60/430,758, filed on Dec. 4, 2002, provisional application No. 60/433,279, filed on Dec. 13, 2002.

(51) Int. Cl.
*F21L 4/00* (2006.01)

(52) U.S. Cl. ..... 362/190; 362/249; 362/247

(58) Field of Classification Search ..... 362/217–218, 362/249, 223, 235, 812, 190–191; 40/572, 40/570, 541
See application file for complete search history.

(56) References Cited

U.S. PATENT DOCUMENTS 1,725,997 A * 8/1929 Price ..... 40/572
3,402,494 A * 9/1968 Gray ..... 40/570
5,365,411 A * 11/1994 Rycroft et al. ..... 362/20
5,950,340 A * 9/1999 Woo ..... 40/564
5,954,423 A * 9/1999 Logan et al. ..... 362/235
6,561,690 B1 5/2003 Balestriero ..... 362/555
6,578,986 B1 6/2003 Swaris ..... 362/249
6,880,952 B1 * 4/2005 Kiraly et al. ..... 362/218
6,929,382 B1 * 8/2005 Kuisma ..... 362/219
6,969,179 B1 * 11/2005 Sloan et al. ..... 362/219

OTHER PUBLICATIONS

Brochure, LEDline.

* cited by examiner

*Primary Examiner*—Ali Alavi
(74) *Attorney, Agent, or Firm*—Fay, Sharpe, Fagan, Minnich & McKee, LLP

(57) ABSTRACT

An illuminated street sign illuminated by LEDs. A light engine comprising a light engine carrier, at least one LED, a heat sink and optionally a reflector and/or lens system is used to illuminate a street sign. The light engine can be retrofit into existing illuminated street signs after removal of the fluorescent tube, attached to the interior of conventional housings or be integrally formed with the housing of an illuminated sign. A pair of light engines are mounted in the housing at an angle to direct the light to the opposite side panel. Each light engine has a reflector. An additional reflector can be mounted n the base of the housing.

32 Claims, 14 Drawing Sheets

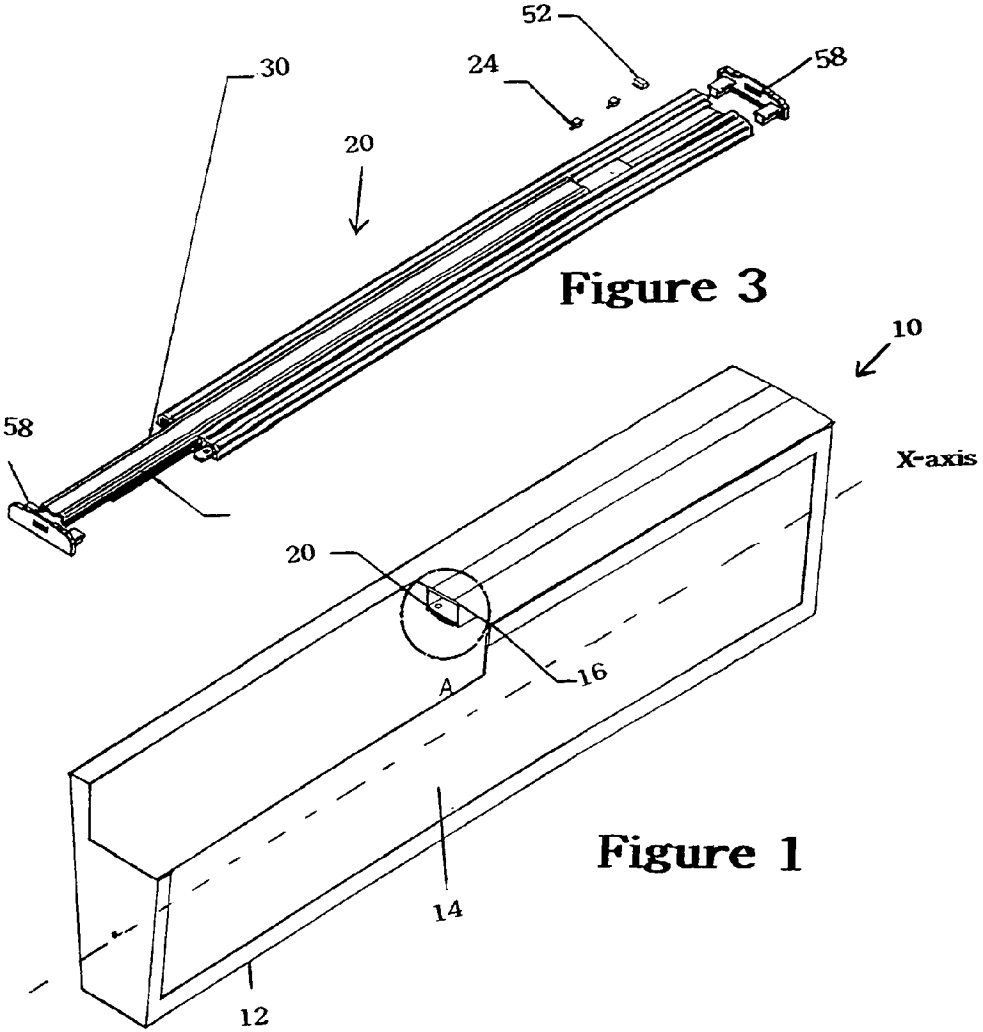
Figure 3
Figure 1
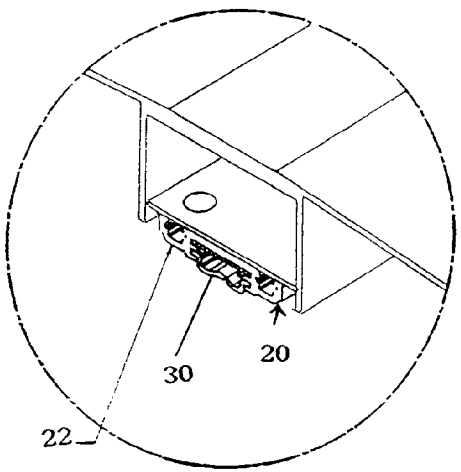
Figure 2

10
10
14
122
122
14
68
34
30
70
72
74

ILLUMINATED LED STREET SIGN

This application is a Continuation-in-Part of U.S. application Ser. No. 10/394,956, filed Mar. 21, 2003 that claimed the benefit of U.S. Provisional Application No. 60/430,758 filed Dec. 4, 2002 and U.S. Provisional Application No. 60/433,279 filed Dec. 13, 2002 all which are hereby incorporated by reference in their entirety.

FIELD OF THE INVENTION

The present invention relates to illuminated street signs. More particularly, the present invention relates to streets signs illuminated with light emitting diodes, known as LEDs.

DESCRIPTION OF THE RELATED ART

Lighted street signs which make use of fluorescent light bulbs are known. The signs typically consist of a housing with signage on one or two sides. The sign is lit from within by fluorescent light.

Usually at least one, and often two sides of the housing are made of a light diffuser made out of, for example, a polycarbonate. The light diffuser typically is either an opaque or translucent material with signage printed on it such as a street name. Alternatively, the light diffuser may be blank.

A fluorescent light is placed in the housing. Typically, the fluorescent light is in the form of a tube. The tube is usually placed at the top of the housing. Light from the florescent tube is emitted into the housing. As the light passes through the diffusers, the sign is illuminated. Although the housing of prior art signs is not made of reflective surfaces, some of the light emitted by the fluorescent tube reflects off the inside of the housing. As a result, the light that passes through the diffuser appears substantially uniform.

A fluorescent tube easily burns out and needs to be replaced often. Thus, there is a need for a long-lasting light source that can be used to illuminate the street signs.

Due to high maintenance costs and poor performance, signs using fluorescent tubes are not normally used in areas which experience cold weather. Known illuminated street signs using fluorescent tubes are only cost-effective in warm climates. Thus, illuminated street signs using fluorescent lights are typically used only in warm climate areas such as in California, Florida, Arizona and Texas. There is a need for an illuminated street sign that is cost effective to use in a wide variety of climates including colder northern climates.

Further, there is a need for an LED light system which can be retrofit into existing illuminated signs.

There is also a need for an illuminated street sign with fewer parts and lower maintenance costs. There is also a need for an illuminated street sign that is easy to manufacture and that can be manufactured at reduced cost.

BRIEF SUMMARY OF THE INVENTION

One embodiment of the present invention is an illuminated street sign. Other embodiments could include any type of illuminated sign such as exit signs, interior and exterior building signs, and the like. The street sign comprises a housing and a light unit contained in the housing. Typically, the housing has a top, bottom, two side panels and two end caps. Preferably, the side panels are made of a polycarbonate diffuser. Preferably at least one of the side panels has signage, such as a street name or other indicia, printed on it or integrally formed in it. Alternatively, the signage could be formed as a mask and be associated with a side panel.

In a first embodiment of the present invention, at least one light engine containing LEDs and all necessary equipment to generate and manage the light is retrofit into an existing sign housing. In a second embodiment, at least one light engine containing the LEDs and all necessary equipment to generate and manage the light is integral with the illuminated street sign, forming part of the housing.

Each light engine includes a carrier, at least one LED, a heat sink or other means to dissipate heat and optionally a reflector and/or lens. The light engine is designed to include materials having good heat transfer characteristics, and is further designed to be in heat transfer contact with support channels in the housing which themselves have good heat transfer characteristics or with the housing itself.

The light output of the LEDs may be managed with lensing and/or reflectors. In a preferred embodiment, reflectors are used to direct the light toward the diffusers. In one embodiment, reflectors located at more than one location is the housing are used. In one embodiment, each light engine includes a relector. In an alternative embodiment, the light engine carrier could be shaped to reflect light that is not directed in the main direction without the addition of a separate reflector. In one embodiment, each separate LED is covered with a lens. In one embodiment, a strip lens covers a plurality of LEDs. The lens collimates the light, distributes the light or both. The light could be collimated along the x and y-axis. Preferably, the light is collimated along only one axis, such as the x-axis. The lensing allows the light which is transmitted to appear uniform. In another embodiment, the light engine has both a reflector and a lens.

The light engine has a means to dissipate heat. In the preferred embodiment, the carrier is in contact with the housing and the housing acts as a heat sink to dissipate heat. In one embodiment, the light engine has a heat sink with fins to dissipate the heat from the carrier. Alternatively, the heat is transferred by heat conduction and/or convection to the interior of the housing. The heat may be conducted out of the housing to the atmosphere. In yet another embodiment, heat is transferred from the LEDs to the PCB.

In one embodiment, the light engine is retrofit into existing illuminated signs after the removal of the fluorescent tube, or the light engine can be used with currently available housings. Alternatively, in a second embodiment, the LED light engine carrier is an integral part of the illuminated sign forming a portion of the housing.

The LEDs are surface mounted and soldered to a metal core PCB laminated with aluminum sheet metal. In an alternative embodiment, LEDs are soldered on a PCB. In one embodiment, the light engine comprises a series of sliding modules comprising a PCB with a plurality of LEDs. In one embodiment, each module slides into a channel in the carrier. The modules interconnect one with the next via an electrical connection between the modules. The electrical connection could be made with cables, wires or any known electrical connector means. In another embodiment, the carrier would only have one module. In an alternative embodiment, the modules are mounted on the carrier and are connected to the carrier by clamping or other known attachment means.

In the preferred embodiment, a pair of LED light engines are located at the top of the housing. Preferably, each light engine is angled toward the opposing side. Preferably, each light engine has an attached reflector. Preferably, there is a third reflector located at the bottom of the housing.

The housing preferably meets NEMA-4 standards for water tightness; however, it is still preferable to put the light engines on top. In case of flooding of the housing, the electronics would not get wet. In one embodiment, the sign has drain holes within the housing in case the sign is damaged and loses its water tightness. Although it is preferable to place the light engine at the top of the sign, it could be placed anywhere within the housing. Alternatively, the light engine could form part of the housing.

In one embodiment, the LEDs are part of a high performance module having twice the number of LEDs. In one embodiment, the high performance module is mounted in the bottom of the housing.

BRIEF DESCRIPTION OF THE FIGURES

FIG. 1 is an illuminated street sign with a partial cutaway showing an LED light engine.

FIG. 2 is an enlarged partial perspective view of the light engine of FIG. 1.

FIG. 3 is a light engine of the present invention.

DETAILED DESCRIPTION OF THE INVENTION

The present invention may be used as an illuminated street sign. These are street signs, often identifying the name of the street, that typically hang over major intersections and are illuminated at night. The street sign is typically about 4 to 6 feet long and about 22 inches high. The size of the sign may depend on the length of the street name, local regulations, or other factors. However, it must be of sufficient size that it can be viewed easily from a moving vehicle. Additionally, the inventive illuminated sign could be used for building signs, business signs, or any other situation where an illuminated sign is desired. It could also be used for lighted street numbers, lighted mailboxes. The inventive light engine assembly could be used with other lighting applications, such as under cabinet lights.

There are two main embodiments of the present invention. The first embodiment is a light engine assembly which is retrofit or otherwise placed into existing standard light housings. One such existing housing is the type A housing Caltrans Illuminated Street Sign. The second embodiment is a light engine assembly which is integral with the light housing.

Illuminated street signs 10 are lighted from within and require light of sufficient intensity that the sign is visible and easily readable despite the surrounding environmental light from, for example, street lights, other signs, vehicles and buildings. Further, the light needs to be sufficiently uniform that the entire sign is substantially uniformly illuminated.

Figures 10, 11:
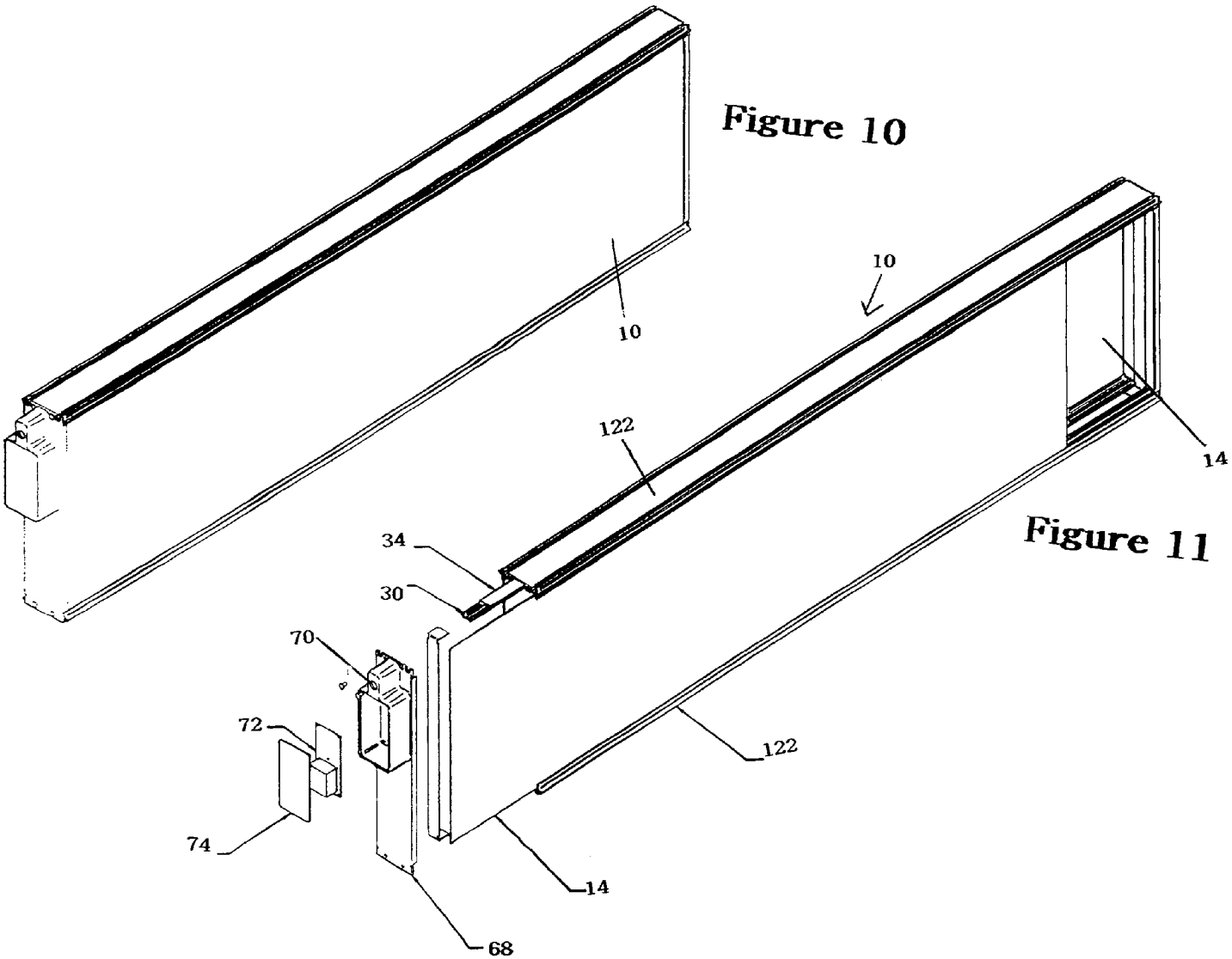
FIG. 10 is a view of an alternative embodiment of the illuminated LED street sign.
FIG. 11 is an exploded view of the street sign of FIG. 10.
Figure 13:
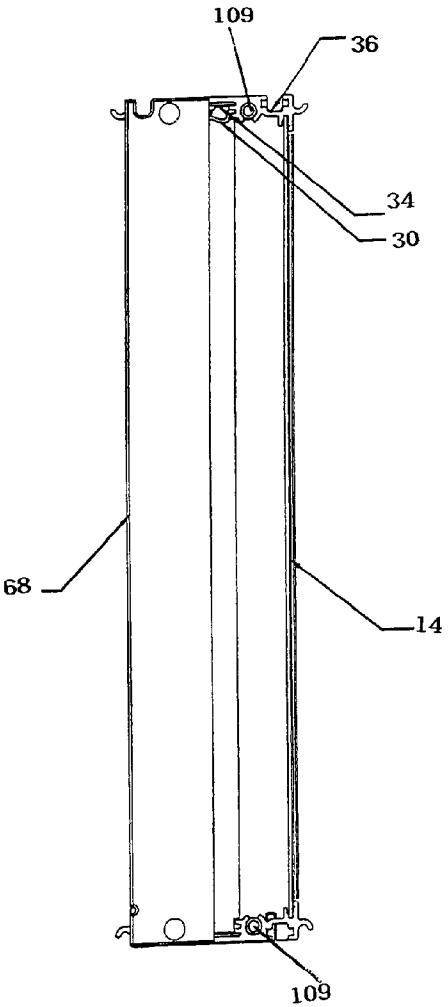
FIG. 13 is a partial cross section of the street sign.
Figure 12:
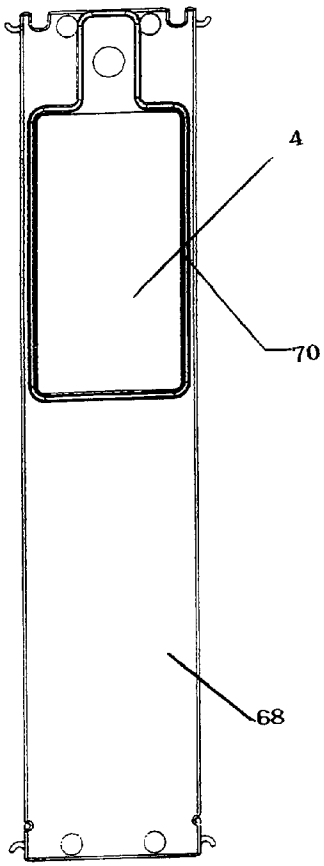
FIG. 12 is a side elevation view of the street sign, with a cutaway showing a portion of the internal structure.
Figure 14:
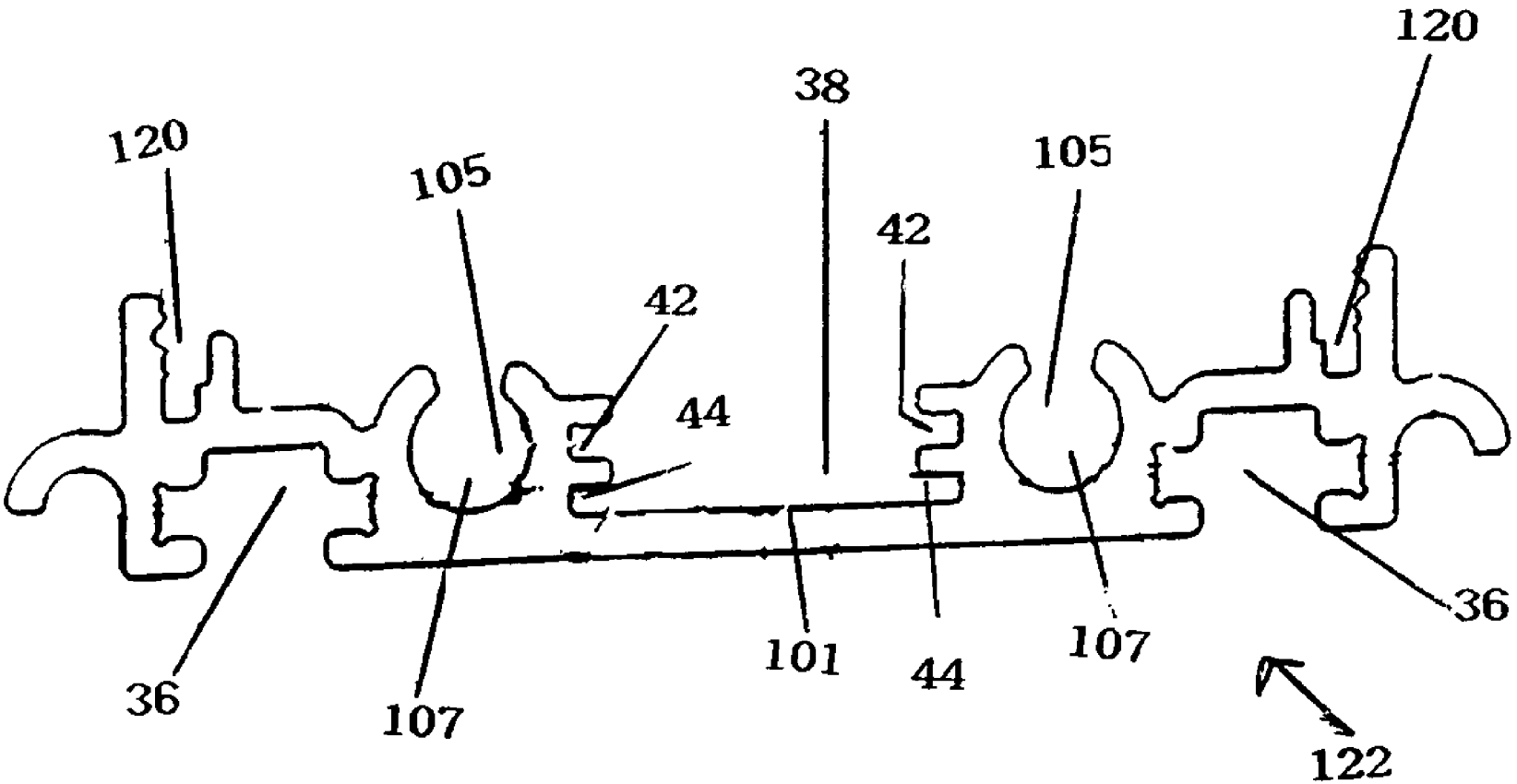
FIG. 14 is a cross section of the carrier of the street sign of FIGS. 10–11.
Figure 15:
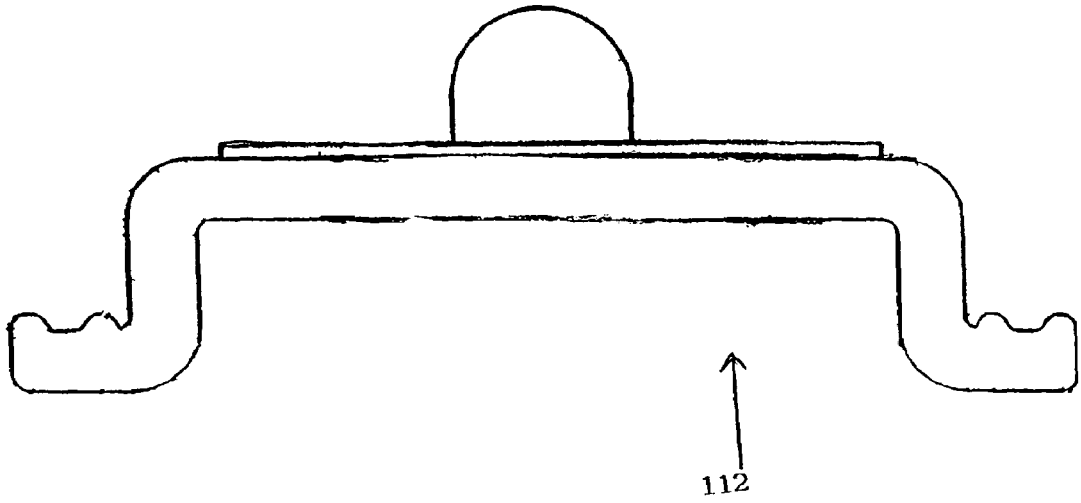
FIG. 15 is a side elevation of a raised slidable element.
Figure 16:
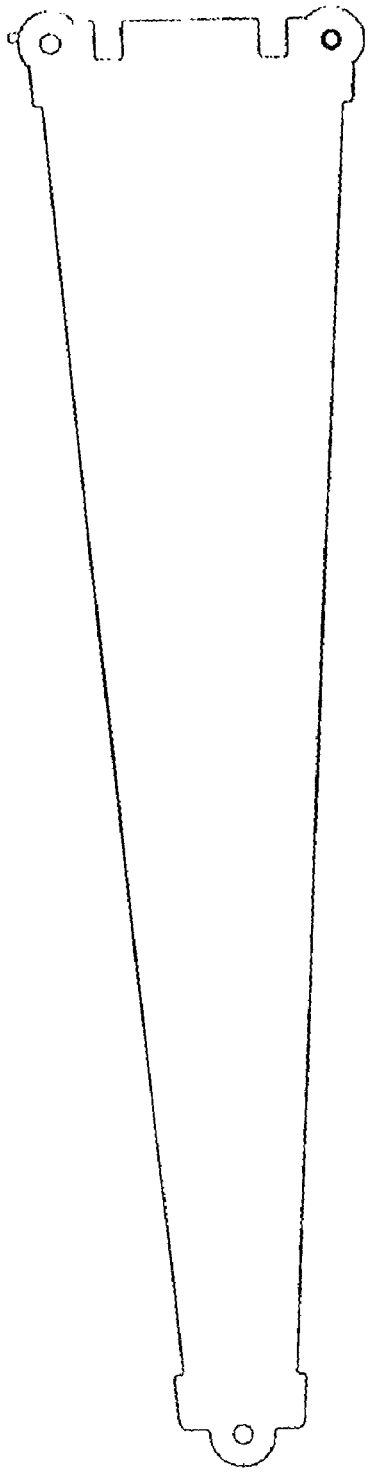
FIG. 16 is a view on an alternative embodiment of an end plate useful when the top and bottom of the housing are of different widths.

As can be seen in FIGS. 1, 10 and 11, the street sign 10 typically has a housing 12. The housing 12 has a top 16, bottom (not shown), two side panels 14, and two end plates 18. At least one side 14 of the housing, preferably two sides 14 of the housing 12 are panels incorporating signage. The side panels 14 are preferably made of a polycarbonate diffuser. Preferably, the side panel 14 is opaque. However, the side panel 14 could be translucent or even transparent. Preferably, the signage is printed on the side panels 14. Alternatively, signage may be integrally molded into the side panel 14 or may be a mask (not shown) associated with a side panel 14. The top 16 and bottom of the housing may have the same or different widths.

Figure 17:
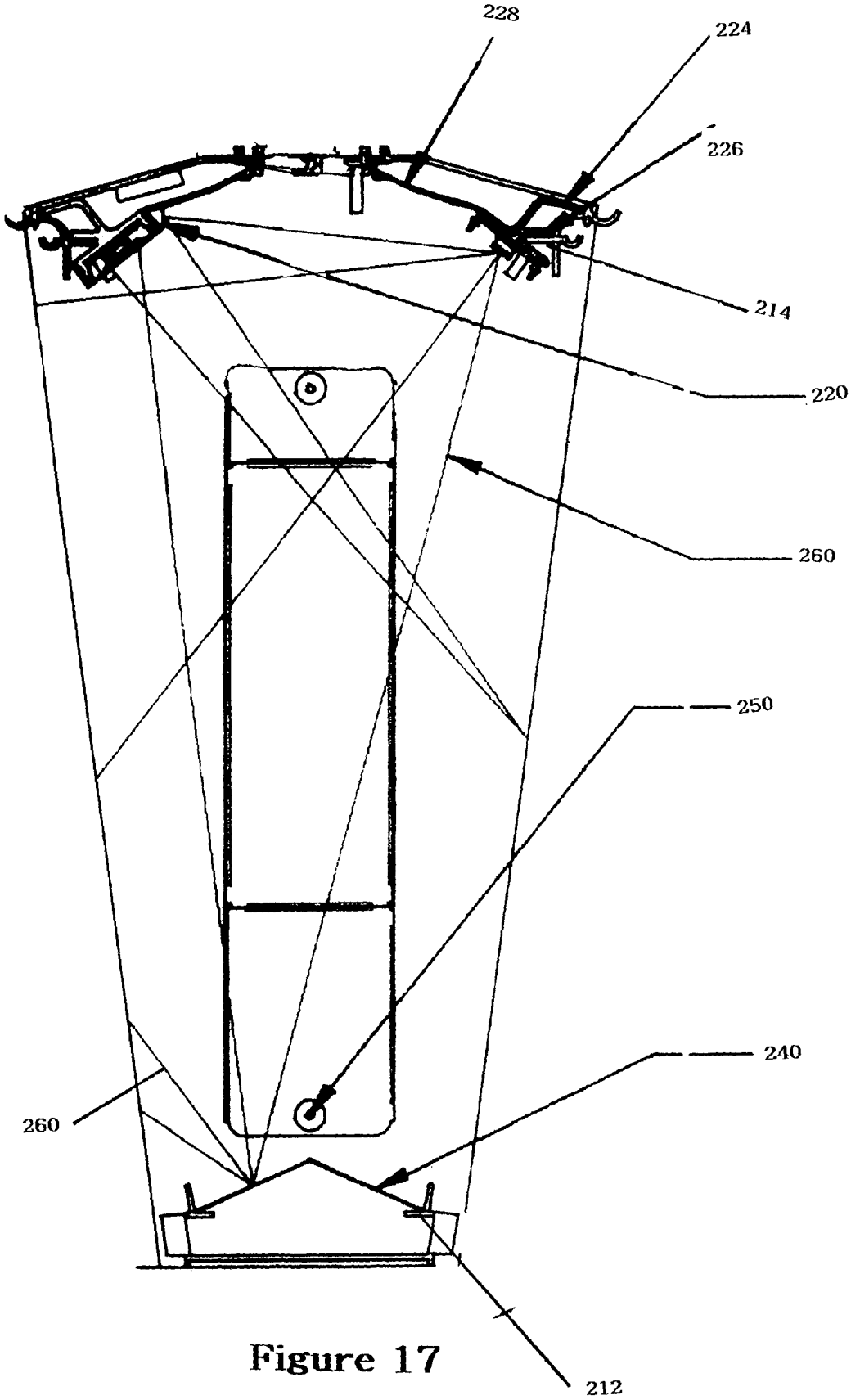
FIG. 17 is a cross section of an alternative embodiment of the street sign.
Figure 21:
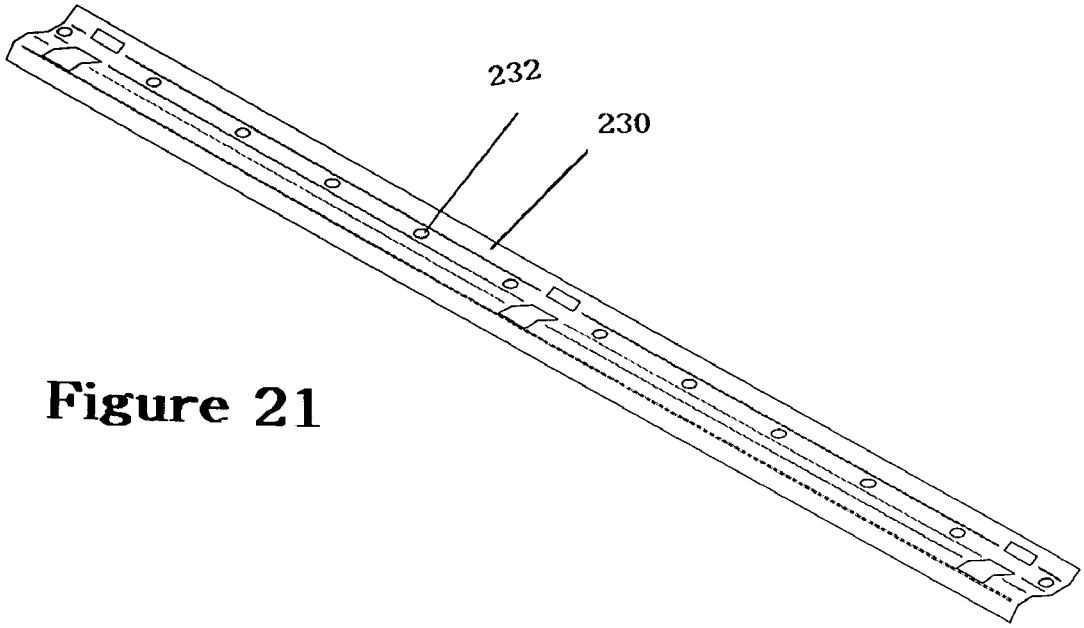
FIG. 21 is a view of the reflector.
Figure 18:
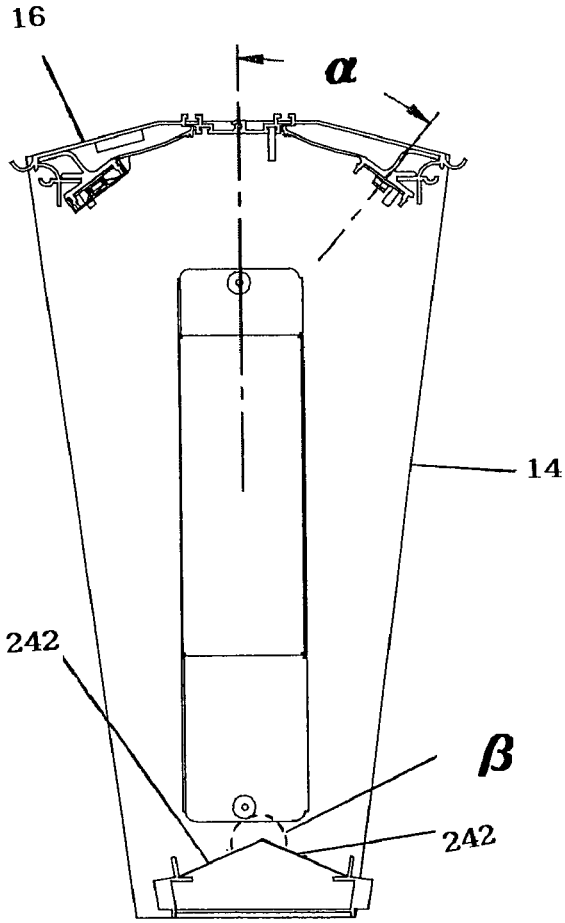
FIG. 18 is a cross section of the street sign of FIG. 17.
Figure 19:
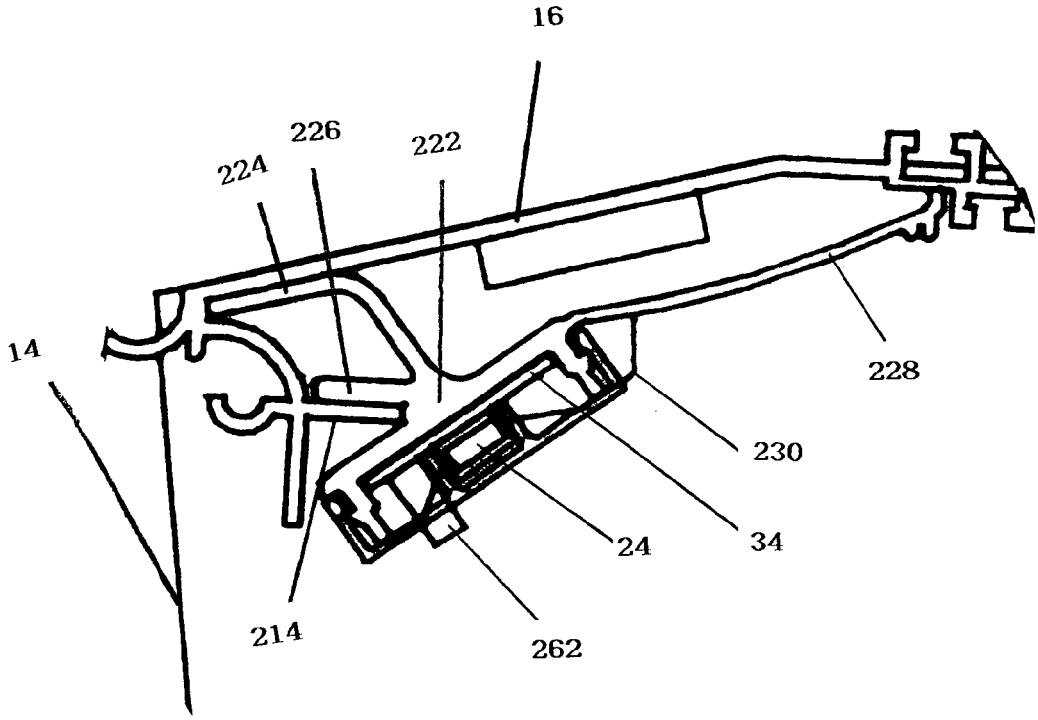
FIG. 19 is an enlarged view of one embodiment of the light engine and carrier of FIGS. 17 and 18.
Figure 20:
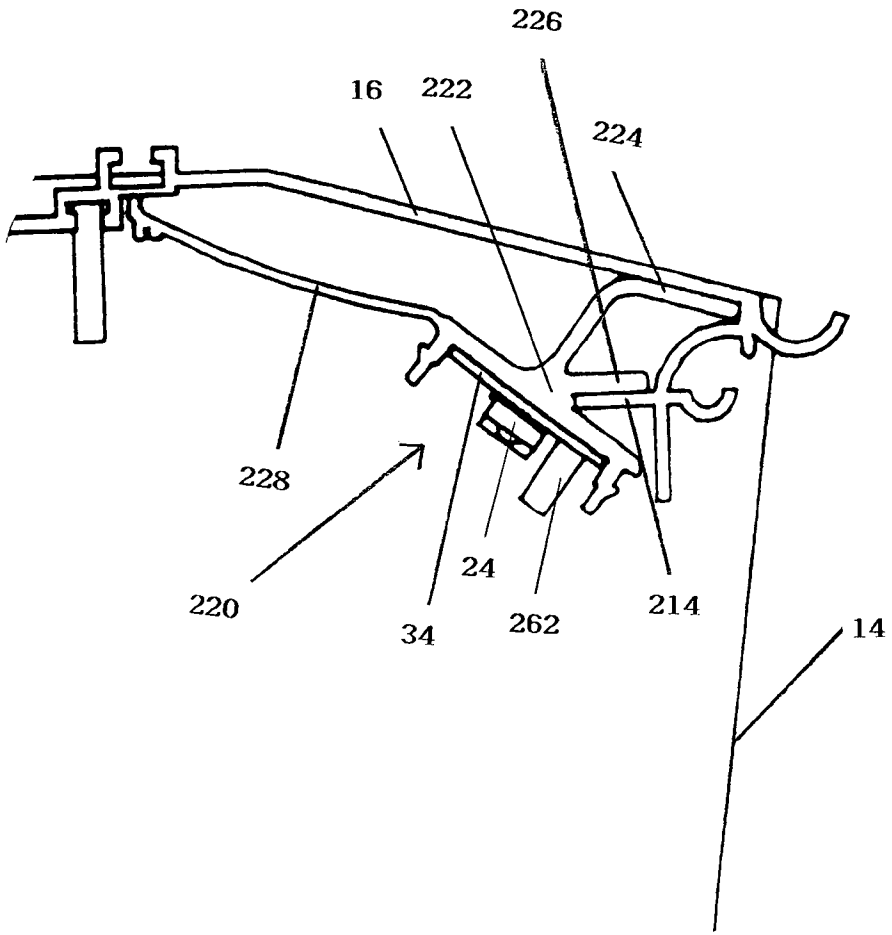
FIG. 20 is an enlarged view of an alternative embodiment of the light engine of FIGS. 17 and 18.

In the first preferred embodiment of the illuminated sign, shown in FIGS. 1 and 17, a light engine is attached to the inside of the housing. It may be retrofit into an existing illuminated street sign after removal of the fluorescent tube or it may be attached in the interior of the housing of a conventional illuminated sign.

In the second preferred embodiment of the illuminated sign, shown in FIGS. 10–11, the light engine and in particular the carrier is formed integrally with the housing. Preferably, the light engine carrier forms either the top, bottom, or both the top and bottom of the housing.

In the first preferred embodiment, as shown in FIGS. 1 and 17, the light engine 20, 220 is capable of being mounted in an existing housing to replace fluorescent tubes. The light engine 20 can be mounted inside the housing at the top or the bottom. Preferably, the light engine 20 is mounted at the interior top of the housing because although the housing 12 should be water tight, it would be undesirable to have the electronics sitting in water should the housing lose its watertightness. Optionally, the housing may have drain holes (not shown) in the bottom of the housing 12 to allow any water that accumulates in the interior of the sign to drain away.

As shown in FIG. 17, a pair of light engines 220 may be mounted in an existing housing 12 to replace fluorescent tubes. Preferably, the light engines 220 are mounted in an angled manner such that the light emitted from the LEDs 24 is directed toward the sides 14. More preferably, there is one light engine on each side of an imaginary midline and each light engine 220 is angled toward the opposing side 14. Most preferably, the light engine 220 includes a reflector to direct light to the sides 14.

In the second preferred embodiment, as shown in FIGS. 10–11, the carrier 122 forms an integral part of the housing 12. As shown in FIGS. 10–14, the street sign 10 has a top beam. The top beam may be an integral part of the housing 12 forming the top 16. The carrier 122 forms the top beam and bottom beam. Preferably, the top and bottom beams are extruded. The extruded top beam and/or the extruded bottom beam (not shown) that are the top 16 and/or bottom of the housing 12 are part of the structural support of the housing. The end caps of the light engine are the end plates 18 of the housing and are attached to the extruded beams. Further, the extruded beams and end plates 18 provide the structural support for the illuminated sign. The light engine is formed from either the top beam, the bottom beam, or both.

Preferably, an extruded beam carrier 122 forms the top and bottom portions of the housing. Side panels 14 are inserted in parallel side panel channels 120 in the extruded top and bottom beams. LEDs 24 and all the equipment to manage the light and maintain the integrity of the light system, including a means to dissipate heat, a lens and/or a reflector, are slidably mounted in the carrier 122.

In both of the preferred embodiments, the light engine 20 comprises a carrier 22, 122, 222 at least one LED 24 and all necessary equipment to manage the light. In the preferred embodiment of the light engine, the light engine has a plurality of LEDs 24. In the preferred embodiment the LEDs 24 are soldered to a PCB 34 and the light engine further comprises a means to dissipate heat.

Figures 4, 5:
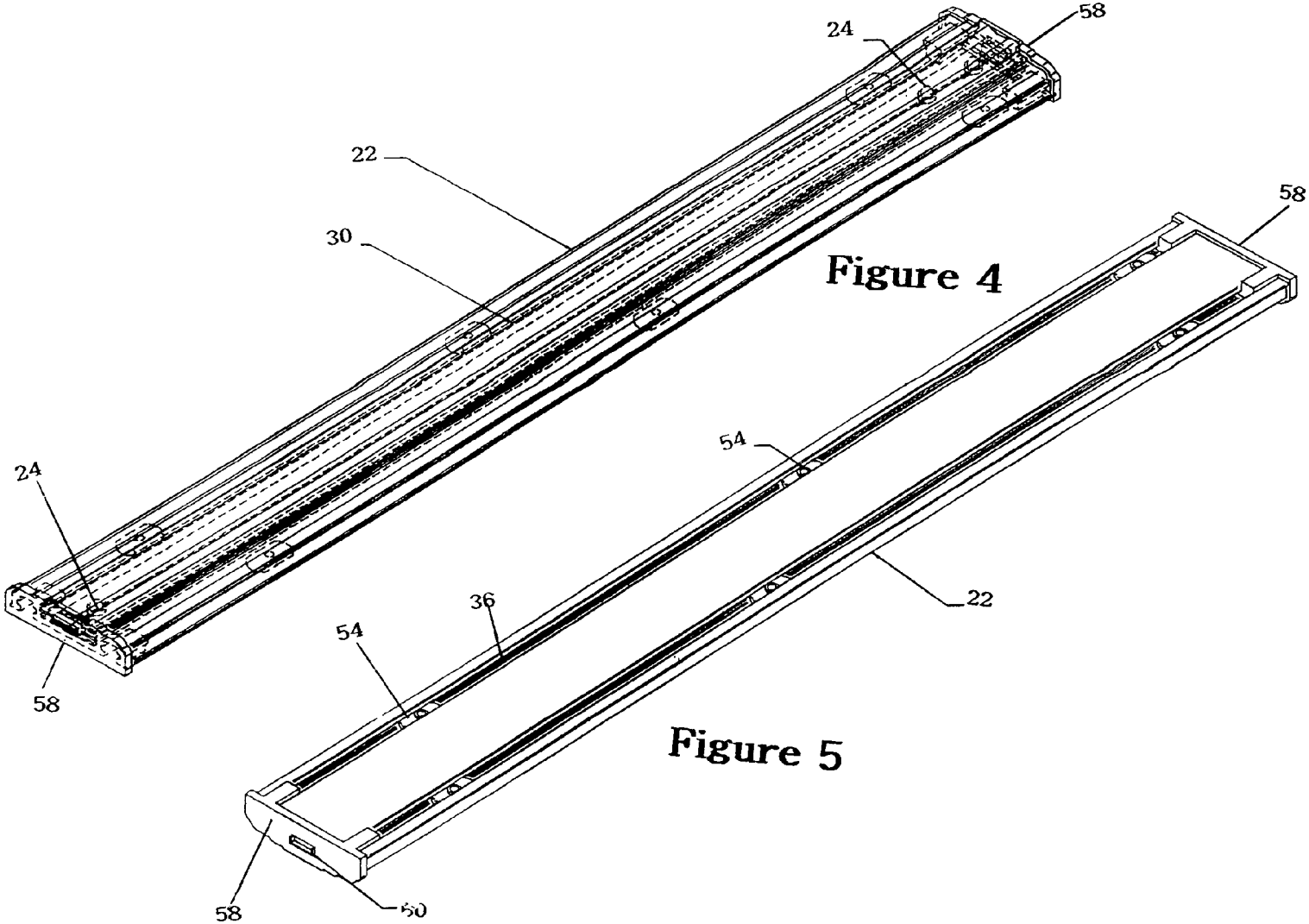
FIG. 4 is a view of an optic side of the light engine of the present invention.
FIG. 5 is a view of the support side of the light engine of the present invention.
Figure 6:
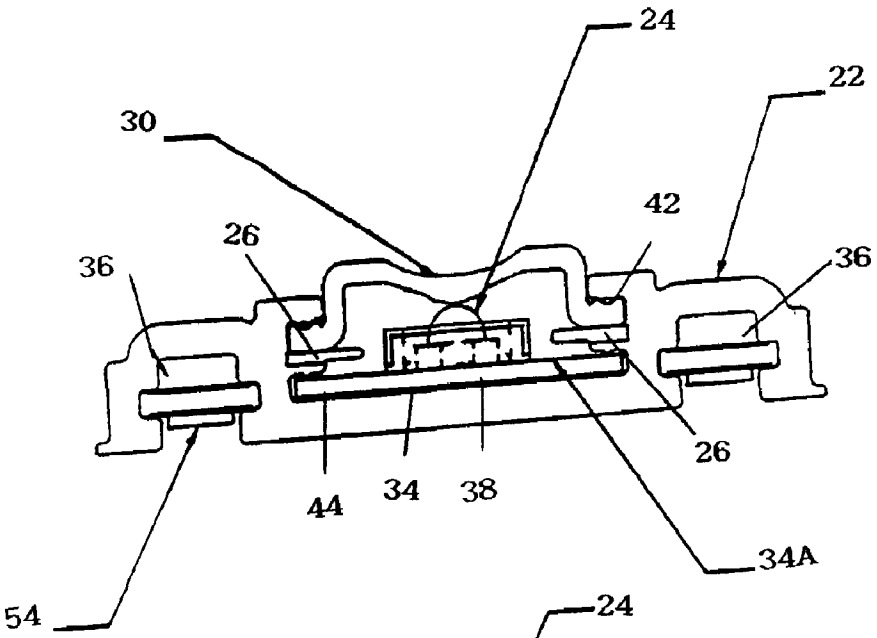
FIG. 6 is a side elevation view of one embodiment of the light engine of the present invention.

As shown in FIGS. 3 and 4 the light engine comprises at least one LED 24 and preferably a plurality of LEDs 24. The number of LEDs 24 depends on the type of LED, the size of the sign, the light output desired, the location of the light engine in the housing, the location of the LEDs on the light engine 20, and the lensing 30 and reflectors 26, 230, 240. Preferably, the LEDs 24 are white LEDs.

Preferably, the LEDs 24 are soldered on a printed circuit board PCB 34. In one embodiment, the PCB 34 is a metal core PCB 34A with at least one LED 24. In an alternative embodiment, the PCB 34B is a standard PCB 34 with at least one LED 24. The PCB 34 is preferably slidably mounted on carrier 22 in a pair of optic tracks 42, 44. The PCB can also be mounted on the carrier by any known means such as clamping.

In an alternative embodiment, the LEDs 24 are surface mounted by being soldered to a metal core PCB 34A that is laminated to aluminum sheet metal. In one embodiment of the present invention, two, three or a plurality of PCBs 34 are interconnected in series one to the next. Preferably, the LEDs are connected in parallel and series on each PCB. Each PCB 34 preferably slides in optic tracks of the carrier 22, 122, 222. If more than one PCB 34 is used, they are preferably interconnected by a connector 52. Preferably, cables are not used to interconnect the PCBs.

In an alternative embodiment, the LEDs 24 are mounted in a high performance light engine having twice the amount of LEDs 24. When the LEDs 24 are part of a high performance light engine, they are preferably mounted in the bottom interior of the housing 12.

Preferably, the light engine carrier 22, 122, 222 is made of extruded aluminum. Most preferably it is made of anodized aluminum. It may be made from other materials having similar heat transfer characteristics. Preferably, the light engine carrier 22, 122, 222 has a channel 38 on an optic side 40 and at least one pair of optic tracks 42, 44 on an optic side 40. More preferably, one optic track 42, 44 of the pair is on each side of the channel 38. The at least one pair of optic tracks extends longitudinally along the length of the carrier 22, 122, 222. More preferably, the optic side has two pairs of parallel optic tracks 42, 44 extending longitudinally along the length of the carrier. The optic tracks 42, 44 are used to guide a sliding lens, reflector and/or PCB. In one embodiment, the mounting side 46 of the light engine carrier 22 has a pair of parallel mounting tracks 36 that extend longitudinally along the length of the carrier. Preferably, the PCB slides are mounted in the channel by sliding it into optic tracks.

Figure 7:
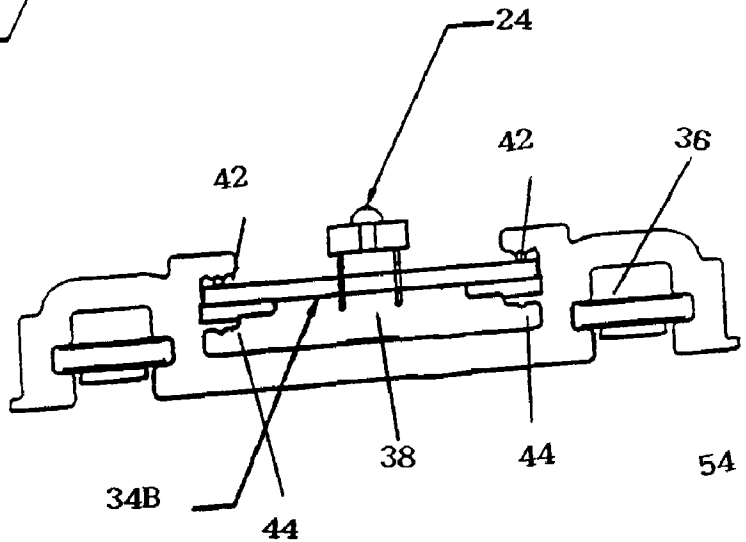
FIG. 7 is a side elevation view of an alternative embodiment of the light engine of the present invention.
Figure 8A:
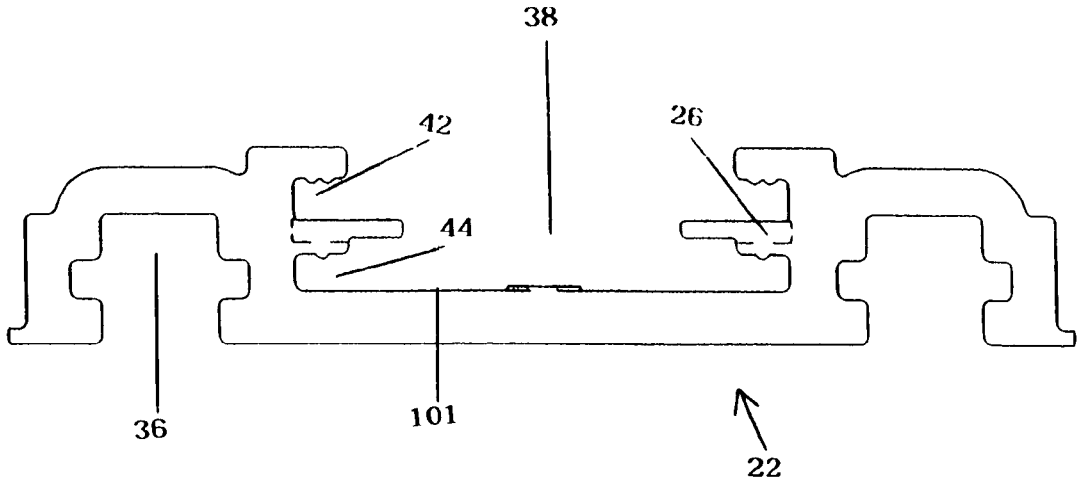
FIG. 8A is a side elevation view of the carrier of FIGS. 6 and 7.
Figure 8B:
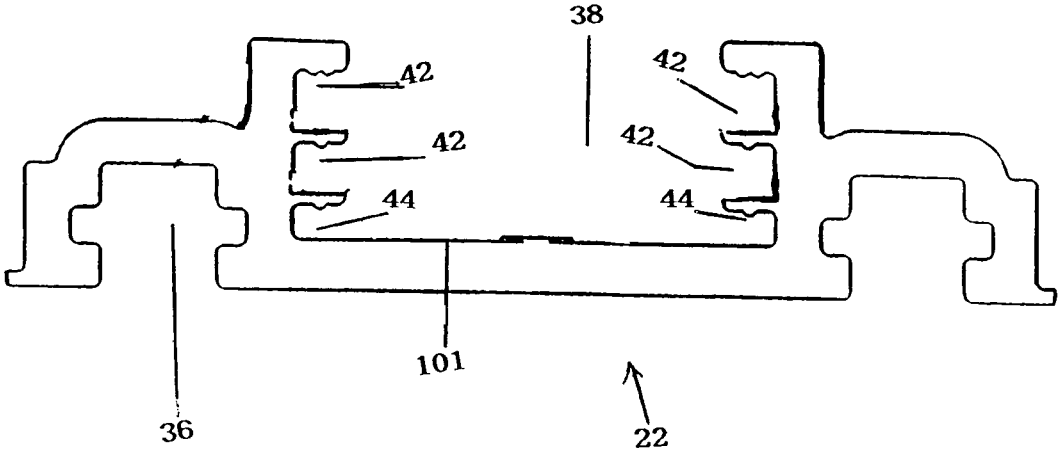
FIG. 8B is an alternative embodiment of a carrier.
Figure 9:
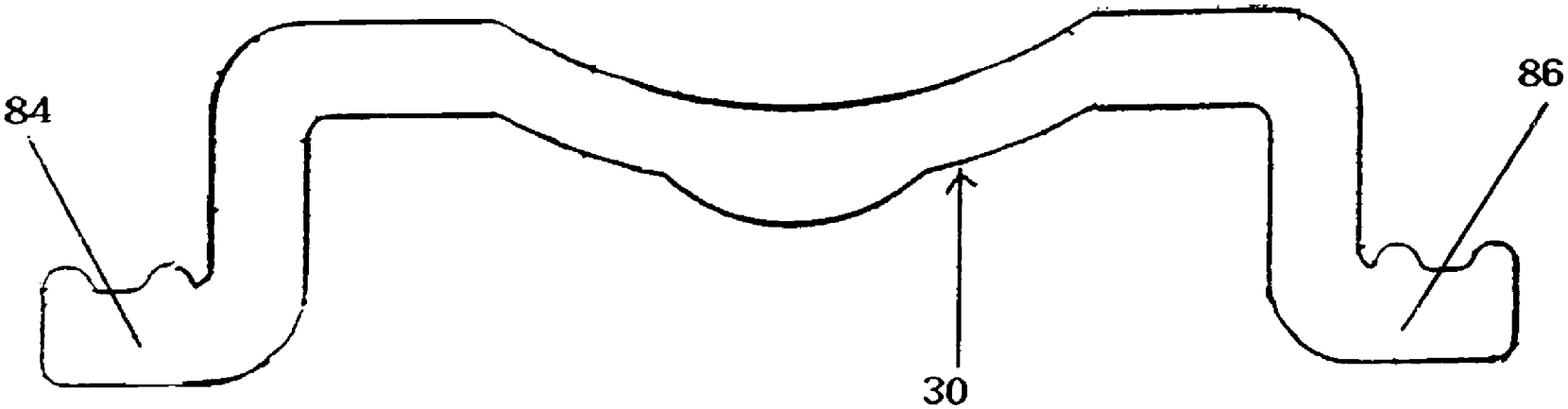
FIG. 9 is a side elevation view of the lens of FIG. 6.

In an alternative embodiment, the LEDs 24 are spaced away from the carrier floor 101. This reduces shadows. The PCB could be mounted in the second pair of optic tracks as shown in FIG. 7. As is shown in FIG. 8B, the carrier could have additional pairs of optic tracks to mount lensing reflectors and/or to raise the LEDs even further. Further, the PCB and LEDs could be mounted on a raised slidable element 112 to raise the LEDs to reduce shadows.

In the preferred embodiment, the light engine 20 has a means to dissipate heat. The means to dissipate heat may be a heat sink. The heat sink optionally includes fins (not shown) which dissipate the heat. In one embodiment, the heat sink transfers heat from the LEDs 24 to the PCB 34 and to the light engine carrier 22, 122, 222. In another embodiment, the heat sink transfers heat to the atmosphere. In one embodiment, the carrier 222 is in contact with the housing 12 and the housing 12 acts as a heat sink.

Carrier 22, 122, 222 may be a separate element or may be formed integrally with the housing. Carrier 222 may have an extension 224 shaped mate with a portion of the housing, such as the top 16. The extension 224 contacts the housing. As a result, heat is dissipated by the housing 12.

In one embodiment, the light engine has mounting elements 54 slidably attached to the light engine carrier 22 or 122. The mounting elements 54 are mounted in mounting tracks 36 and can be slid along mounting tracks 36. The light engine 20 may be mounted into a housing 12 or to an arm of a sign post (not shown). The slidable mounting elements 4 allow the light engine to be mounted into a variety of signs or on a variety of sign posts without the need to change the mounting hardware.

In one embodiment, the light engine includes at least one lens 30. The lens 30 directs the light toward the side panels 14. Preferably, the lens 30 is a strip that slides in front of the LEDs 24. Alternatively, each LED has each its own lens (not shown). Preferably, the lens has rails 84, 86 and is slidably mounted by guiding the rails into a pair of optic tracks 42 in front of the LEDs.

The lens 30 may collimate the light, diffuse the light or both. In one embodiment, the lens 30 collimates the light on the x and y-axis. Preferably, the lens 30 collimates the light only on one axis, either the x or the y-axis. Most preferably, the lens 30 collimates the light on one axis only and also distributes the light. By distributing the light, the light that is transmitted by the side panels appears more uniform.

In a preferred embodiment, a pair of carriers 222 are positioned at the top of a housing. Each carrier 222 is mounted on the side of an imaginary centerline. The carriers 222 are mounted at an angle $\alpha$. Preferably, the carriers are mounted such that the LEDs 24 are directed toward the lower interior of the housing 12 by angling them toward the interior of the housing 12 and angle $\alpha$ from vertical. Preferably, the carriers are angled between 34° and 45° degrees from vertical. Most preferably, the carriers are angled toward the center of the housing 390 from vertical. If only one side panel 14 has signage, a single carrier 222 angled toward that side 14 may be used. The single angled carrier 222 is used when one only wants one side to be illuminated.

In a preferred embodiment, the carriers 222 each have an extension 224 in contact with the housing. This allows the entire housing to dissipate heat. Preferably, the extension 224 has the same contour as the housing 12. The extension 224 thus has a significant contact area with the housing 12.

Preferably, the angled carriers have reflectors 230 to direct the light 260 to the sides 14. Light engine 220 is used in conjunction with at least one reflector 230. The preferred reflector 230 has a series of apertures 232 placed over the LEDs 24 such that the LEDs 24 are aligned with the apertures. The reflector is held in place with a clip.

A reflector 230 directs the light and ensures substantial uniformity of the light that is transmitted through the side panels 14. Reflector 230 directs light toward a side panel 14. In the preferred embodiment, a separate reflector 230 is mounted on the light engine carrier 222. In another embodiment, the light engine carrier 22, 122, 222 is shaped to reflect the light. In one embodiment, the light engine carrier 22, 122, 222 may be made from or coated with a reflective material. In another embodiment, the light engine has both a lens 30 and a reflector 230.

In a preferred embodiment, there is an additional reflector 240 spaced away from the light engine 220. The additional reflector 240 is shaped to direct light not incident on the side panels 14 back to the side panels 14. The reflector 240 ensures substantially uniform light distribution through the side panels 14 and minimizes lost light. More preferably, the additional reflector is located in the bottom of the housing 12 to direct light 260 up to the side panels 14. If both sides 14 are to be illuminated the additional reflector is preferably two planar surfaces 242 angled more than 180° from each other.

The specific angle β is based on what is needed to direct the light to the side panels 14. If only one side is illuminated, a single planar reflector angled to direct light to the side panel is used. In one embodiment, the housing 12 has a pair of ribs 212 at its base. The additional reflector 240 is spring mounted into the ribs 212.

In one embodiment, the light engine 20 is a sliding module. Preferably, the module is about 24 inches long. In one embodiment, the module can interconnect with at least one other sliding module. The sliding modules electrically connect. Jumper 262 is used to close the loop when a more than one PCB 34 is connected in series. In one embodiment, the housing has a channel in its interior into which the sliding modules fit.

In one embodiment, the light engine has a pair of end caps 58. The end caps 58 may have an input connector 60 for connecting a power supply (not shown) to the light engine. Optionally, a controller and/or other circuitry (not shown) could be connected to the light engine. In one embodiment, as shown in FIGS. 1, 3, 6 and 7 the end caps 58 are snap fit into the mounting tracks 36 and provide structural support for the light engine 20.

In an alternative embodiment, the end caps 68 form the end plates 18 of the housing 12. Preferably the end plates 18 are attached to the housing top 22 by an attachment means such as bolts or screws. In the embodiment shown in FIGS. 13 and 14, the top and bottom beams have a pair of troughs 105. The ends of the troughs 105 have apertures 107 for receiving an adapter 109 which allows the end caps 68 to be secured to the top and bottom beams. Alternatively, the end plates can be formed integrally with another part of the housing. Preferably, a power supply housing 70 is formed integrally within at least one end plate and a power supply 72 is located in the power supply housing. The power supply housing 70 protects the street sign power supply. The power supply housing 70 preferably has one open end closed by a power supply cover 74.

In one embodiment, the light engines 220 are retrofit into an existing housing 12, such as a Type A Housing for a Caltrans Illuminated Street Sign. The housing has a ledge 214 running its length. A first support arm 226 running the length of the carrier is supported on the ledge. The carrier has a second support arm 228 running the length of the carrier. The second support arm 228 is attached to the top 16 of the housing 12 by a mechanical attachment such as a C-bracket.

When the light engine 220 are being retrofit into an existing housing 12, it is preferable that the carrier is mounted such that the LEDs 224 will be directed at the proper angle to direct the light to the sides 12 and the lateral extension 224 matches the contour of the top 16 of the housing 12 to encourage heat dissipation.

In retrofit applications it is preferable to mount the power supply in the fluorescent tube socket holes 250.

The invention claimed is:

1. A carrier for a light engine comprising:

a mounting surface residing on a first side; said mounting surface having a first support arm, a second support arm and a contoured projection extending longitudinally, said contoured projection is adapted to contact a housing; and an optic surface residing on a second side; said optic surface having a central channel, a pair of sidewalls, and a pair of tracks in which a PCB having at least one LED is slidably mounted.

2. The carrier of claim 1, wherein the carrier is made of extruded aluminum.

3. The carrier of claim 1, further comprising a reflector.

4. The carrier of claim 3 wherein the reflector has at least one aperature, said aperature aligned with at least one LED.

5. The carrier of claim 3 further comprising at least one clip, said clip connecting the reflector to the carrier.

6. The carrier of claim 1 wherein the sidewalls are shaped to reflect the light.

7. The carrier of claim 1 further comprising a reflective coating on at least a portion of the carrier.

8. The carrier of claim 1 further comprising at least one lens.

9. The carrier of claim 3 further comprising at least one lens.

10. The carrier of claim 1 further comprising a light engine mounted on said optic surface.

11. The carrier of claim 10 wherein the light engine comprises at least one printed circuit board and at least one light emitting diode mounted on at least one printed circuit board.

12. The carrier of claim 1 wherein the first support arm is adapted to be supported by a horizontal ledge in the housing.

13. The carrier of claim 1 wherein the first support arm is horizontal and the optic surface is angled 34 degrees and 45 degrees from vertical.

14. The carrier of claim 13 wherein the optic surface is angled about 39 degrees from vertical.

15. The carrier of claim 12 wherein the first support arm runs the length of the carrier.

16. The carrier of claim 12 wherein the second support arm runs the length of the carrier.

17. The carrier of claim 1 wherein the contoured projection is adapted to dissipate heat to the housing.

18. The carrier of claim 1 wherein there is significant contact between the housing and the contoured projection.

19. The carrier of claim 18 wherein the contoured projection has the substantially same contour as the housing at the areas where the contoured projection and the housing are in contact.

20. The carrier of claim 11 further comprising at least two pcbs, said pcbs connected in series by at least one jumper.

21. The carrier of claim 1 wherein the second support arm is adapted to attach to a top of the housing.

22. The carrier of claim 21 wherein the second support arm is adapted to mechanically attach to the top of the housing.

23. The carrier of claim 11 wherein the first support arm is adapted to be supported by a horizontal ledge in the housing.

24. The carrier of claim 11 wherein the first support arm is horizontal and the optic surface is angled between 34 degrees and 45 degrees from vertical.

25. The carrier of claim 24 wherein the first support arm is horizontal and the optic surface is angled between 34 degrees and 45 degrees from vertical.

26. The carrier of claim 24 wherein the optic surface is angled about 39 degrees from vertical.

27. The carrier of claim 13 wherein the first support arm runs the length of the carrier.

28. The carrier of claim 27 wherein the second support arm runs the length of the carrier.

29. The carrier of claim 27 wherein there is significant contact between the housing and the contoured projection.

30. The carrier of claim 29 wherein the contoured projection has the substantially same contour as the housing at the areas where the contoured projection and the housing are in contact.

31. The carrier of claim 30 wherein the contoured projection is adapted to dissipate heat to the housing.

32. The carrier of claim 29 wherein the second support arm is adapted to attach to a top of the housing.

* * * * *